US009102078B2

(12) United States Patent
Hartwell

(10) Patent No.: US 9,102,078 B2
(45) Date of Patent: Aug. 11, 2015

(54) CUTTING METHOD FOR STONE LAMINATE PANELS

(71) Applicant: Bellcomb, Inc., Minneapolis, MN (US)

(72) Inventor: David B. Hartwell, Minneapolis, MN (US)

(73) Assignee: Bellcomb, Inc., Minneapolis, MN (US)

( * ) Notice: Subject to any disclaimer, the term of this patent is extended or adjusted under 35 U.S.C. 154(b) by 159 days.

(21) Appl. No.: 13/833,484

(22) Filed: Mar. 15, 2013

(65) Prior Publication Data

US 2014/0190464 A1 Jul. 10, 2014

Related U.S. Application Data

(60) Provisional application No. 61/751,095, filed on Jan. 10, 2013.

(51) Int. Cl.
*B28D 1/08* (2006.01)
*B28D 1/10* (2006.01)
*B28D 7/04* (2006.01)

(52) U.S. Cl.
CPC .. *B28D 1/10* (2013.01); *B28D 1/08* (2013.01); *B28D 7/04* (2013.01); *Y10T 29/49771* (2015.01); *Y10T 29/49826* (2015.01)

(58) Field of Classification Search
CPC ..... B28D 1/08; B28D 1/00; B28D 7/04; Y10T 29/49771; Y10T 29/49826
USPC ..... 125/16.02, 16.01, 13.01, 12, 35; 451/365, 547, 41, 57
See application file for complete search history.

(56) References Cited

U.S. PATENT DOCUMENTS

| | | | | |
|---|---|---|---|---|
| 3,950,202 | A * | 4/1976 | Hodges | 156/154 |
| 4,436,078 | A * | 3/1984 | Bourke | 125/13.01 |
| 5,339,795 | A | 8/1994 | Myles | |
| 5,605,141 | A * | 2/1997 | Bilotta | 125/16.02 |
| 6,843,242 | B2 * | 1/2005 | Marocco | 125/1 |

* cited by examiner

*Primary Examiner* — Robert Rose
(74) *Attorney, Agent, or Firm* — Fredrikson & Byron P.A.

(57) ABSTRACT

A method of preparing a plurality of workpieces for concurrent cutting using a stone cutting machine is disclosed. Each workpiece can include a stone slab that has two parallel faces and one or more edges, a substrate that is bonded to a first face, and a substrate that is bonded to a second face of the stone slab. The stone cutting machine can have a plurality of stone cutting elements and it can be configured to concurrently create a plurality of stone cuts. The method can include: providing a plurality of workpieces; and positioning the plurality of workpieces by placing a set of shims between adjacent pairs of workpieces. The set of shims can be placed to compensate for variations in workpiece thickness and/or to position each of the workpieces with one edge of each stone slab in relative alignment with one of the stone cutting elements.

18 Claims, 9 Drawing Sheets

CUTTING METHOD FOR STONE LAMINATE PANELS

PRIORITY

This application claims priority to U.S. provisional patent application No. 61/751,095 filed Jan. 10, 2013, entitled Cutting Method for Stone Laminate Panels, which is hereby incorporated by reference herein in its entirety.

TECHNICAL FIELD

The present disclosure generally relates to producing stone laminate panels, and more particularly to an improved method for producing stone laminate panels.

BACKGROUND

Stone laminate panels can be made from a relatively thin stone veneer which has been bonded to a substrate, which can be a honeycomb core, honeycomb core panel, other core material or panel. Stone laminate panels can be employed for a variety of uses, including architectural cladding applications in order to utilize natural stone for a range of interior and exterior purposes. Using stone laminate panels can result in a substantial weight reduction, which can be in the order of about 60-80%, as compared to stone slabs. The lightweight nature of stone laminate panels, in contrast to stone slabs, can make them easier to install, because they can eliminate the need for heavy lifting equipment, and other challenges due to weight, during installation. In addition, buildings may not need to be designed to support traditional, and heavier stone slabs.

The starting point commodity for producing stone laminate panels is stone slabs. Stone blocks are mined in stone quarries and then cut into stone slabs, either close to the quarry or in facilities designed to create slabs, which can be located around the world. Stone slabs can be shipped in a wide variety of sizes, however, stone slabs are typically either 2 or 3 centimeters thick. Of course other thicknesses are also possible, and slab thicknesses of 4, 5, 6 or 7 centimeters, for example, can be obtained. As shipped from a quarry, stone slabs can be approximately from about 3 to 6 feet wide and from about 6 to 12 feet long. Stone slabs can weigh in the order of about 1,000 pounds each, which will vary depending on both the type stone as well as the slab dimensions.

As shipped from a slab processing facility, stone slabs should be flat on each side, however, perfect flatness is not guaranteed. In some uses, the flatness of a stone slab can be an important parameter to downstream operations. As a result, some stone laminate panel manufacturers process each received stone slab, so that each side is flat to within required specifications, as a preparatory step in manufacturing stone laminate panels. In addition, stone slabs can also be trimmed to a desired length and width prior to further processing.

In typical processing facilities a single stone stab is processed into two stone laminate panels. The process starts by bonding a substrate to each side of a stone slab to create a sandwich panel or panel assembly. Typically, an aluminum honeycomb substrate is used; however, other substrates can also be used. The finished product is made by cutting the sandwich panel in two to produce two stone laminate panels; each of the two stone laminate panels comprising a stone veneer typically of about 0.25 inch thickness, which remains bonded to the substrate. Depending upon the type of stone used in the stone laminate panel, and/or the intended application for the panel, the stone veneer thickness can vary.

The resulting stone laminate panels weigh less than the received stone slabs. Weight reduction can be a main goal in creating stone laminate panels as reduced weight can be advantageous for some applications. For example, when a stone finish is desired for the interior of elevator cars, reducing the weight of the stone used reduces the overall weight of the elevator car. This can result in a reduction in the inertial weight (including a reduction in the weight of the car's counterweight) that must be moved each time the elevator car moves. When used as a building facade, a panel with less weight results in a reduction in the required lifting capacity of construction cranes that are used to position the panels, as well as reducing the required robustness of the sub-structure and the fastening hardware required to retain the panels in place. Additionally, stone laminate panel shipment weight to a job site is reduced, as compared to shipping stone slabs, which often reduces the costs of transportation.

Sandwich panels are cut in two, one panel at a time. For cutting, panels are placed horizontally (the sandwich panel is laying flat during the cut) and a wire cutter, typically comprised of diamond beads on a cable core, is used. Each cut takes approximately 8 to 10 hours to complete depending on the stone and the size of the tool which makes the cut. Other cutting methods can also be used, but each method is limited to cutting a single sandwich panel at a time on a single machine, each taking many hours.

It would be desirable to provide a panel cutting method allowing for cutting of a plurality of panels.

SUMMARY

In some aspects, the present disclosure features a method of preparing a plurality of workpieces for concurrent cutting using a stone cutting machine. Each of the plurality of workpieces can include a stone slab that has two parallel faces and one or more edges, a substrate that can be bonded to a first face of the stone slab, and a substrate that can be bonded to a second face of the stone slab. The stone cutting machine can have a plurality of stone cutting elements and can be configured to concurrently create a plurality of stone cuts. The method can include providing a plurality of workpieces; and the plurality of workpieces can be positioned as a stack of workpieces to position each of the workpieces with one edge of each stone slab in relative alignment with one of the stone cutting elements.

Implementations may include one or more of the following features. For example, a set of shims can be placed between an adjacent pair of workpieces. A set of shims can be placed in order to position each of the workpieces such that one edge of each stone slab can be in relative alignment with one of the stone cutting elements, and/or the set of shims can be placed in order to compensate for variations in workpiece thickness.

In some aspects, the present disclosure features a method of arranging a plurality of workpieces on a rack for concurrent cutting by a stone cutting machine that can be configured to make vertical cuts. Each of the plurality of workpieces can include a stone slab that has two parallel faces and one or more edges, a substrate that can be bonded to a first face of the stone slab, and a substrate that can be bonded to a second face of the stone slab. The stone cutting machine can have a plurality of stone cutting elements and can be configured to concurrently create a plurality of stone cuts. The rack can be configured to accept a plurality of workpieces in a horizontal orientation and to present the plurality of workpieces in a vertical orientation for cutting. The method can include: A first workpiece can be placed on the rack in a horizontal orientation. The top surface of the first workpiece can be measured relative to a reference site. A first shim level can be calculated. A first set of shims can be arranged on top of the top surface of the first workpiece according to the first shim level. A second workpiece can be placed on the rack in a horizontal orientation, the second workpiece can be placed on top of the first set of shims.

In some aspects, the present disclosure features a method of arranging a plurality of workpieces on a rack for concurrent cutting by a stone cutting machine. The stone cutting machine can have a plurality of stone cutting elements and can be configured to concurrently create a plurality of vertical stone cuts. The rack can be configured to accept a plurality of workpieces in a horizontal orientation and to present the plurality of workpieces in a vertical orientation for cutting. The method can include (A) providing a plurality of workpieces for cutting. Each of the plurality of workpieces can include a stone slab that can have two parallel faces and one or more edges, a substrate that can be bonded to a first face of the stone slab, and a substrate that can be bonded to a second face of the stone slab. (B) One or more reference sites can be established on the rack. (C) A first workpiece can be placed on the rack in a horizontal orientation. (D) The top surface of the first workpiece can be measured relative to the one or more reference sites. (E) A first shim level can be calculated. (F) A first set of shims can be arranged on top of the top surface of the first workpiece, where the first set of shims can be arranged according to the first shim level. (G) A second workpiece can be placed on the rack in a horizontal orientation, the second workpiece can be placed on top of the first set of shims.

In some aspects, the present disclosure features a method of arranging a plurality of workpieces on a rack for concurrent cutting by a stone cutting machine that is configured to make vertical cuts. Each of the plurality of workpieces can include a stone slab that can have two parallel faces and one or more edges, a substrate that can be bonded to a first face of the stone slab, and a substrate that can be bonded to a second face of the stone slab. The stone cutting machine can have a plurality of stone cutting elements. Each of the plurality of stone cutting elements can be configured to cut through stone, such that the stone cutting machine can be configured to concurrently create a plurality of stone cuts. The rack can be configured to accept a plurality of workpieces in a horizontal orientation and to present the plurality of workpieces in a vertical orientation for cutting. The method can include (A) placing a first workpiece on the rack in a horizontal orientation. (B) The top surface of the first workpiece can be measured to determine (i) the flatness of the top surface, and (ii) an angle that a plane, that is substantially through the top surface, makes with a horizontal plane. (C) The thickness of a second workpiece can be measured. (D) A first shim level can be calculated. The first shim level calculation can include (i) the flatness of the top surface of the first workpiece, (ii) the angle that the plane makes with the horizontal plane, (iii) the location of at least one of the plurality of stone cutting elements, and (iv) the thickness of the second workpiece. (E) A first set of shims can be arranged on top of the top surface of the first workpiece. The first set of shims can be arranged according to the first shim level. (F) The second workpiece can be placed on the rack in a horizontal orientation, where the second workpiece can be placed on top of the first set of shims.

In some aspects, the present disclosure features a method for preparing a plurality of workpieces for concurrently cutting. The method can include (A) providing a stone cutting machine that can be configured to make vertical cuts. The stone cutting machine can have a plurality of stone cutting elements and can be configured to concurrently create a plurality of stone cuts. (B) A rack can be provided that can be configured to accept a plurality of workpieces in a horizontal orientation and to present the plurality of workpieces in a vertical orientation for cutting. (C) A plurality of workpieces can be provided for cutting. Each of the plurality of workpieces can include a stone slab that can have two parallel faces and one or more edges, a substrate that can be bonded to a first face of the stone slab, and a substrate that can be bonded to a second face of the stone slab. (D) One or more reference sites can be established on the rack. (E) A first workpiece can be placed on the rack in a horizontal orientation. (F) The top surface of the first workpiece can be measured relative to the reference sites. (G) A first shim level can be calculated where the first shim level calculation can include (i) the measurement of the top surface of the first workpiece and (ii) the location of at least one of the stone cutting elements. (H) A first set of shims can be arranged on top of the top surface of the first workpiece. The first set of shims can be arranged according to the first shim level. (I) A second workpiece can be placed on the rack in a horizontal orientation, where the second workpiece can be placed on top of the first set of shims.

In some aspects, the present disclosure features a method for preparing a plurality of workpieces for concurrent cutting. The method can include (A) providing a stone cutting machine that can have a plurality of stone cutting elements and that can be configured to concurrently create a plurality of stone cuts. (B) A rack can be provided that can be configured to accept a plurality of workpieces in a horizontal orientation and to present the plurality of workpieces in a vertical orientation for cutting. (C) A plurality of workpieces can be provided for cutting. Each of the plurality of workpieces can include a stone slab that has two parallel faces and one or more edges, a substrate that can be bonded to a first face of the stone slab, and a substrate that can be bonded to a second face of the stone slab. (D) One or more reference sites can be established on the rack. (E) The method can also include sequentially (i) measuring the top surface of each workpiece relative to the reference sites after each workpiece is placed horizontally in position on the rack, (ii) calculating a shim level for the workpiece, and (iii) arranging a set of shims on the top surface of the workpiece (at one or more shim sites) according to the shim level for the workpiece.

Implementations may include one or more of the following features. For example, measuring the top surface of the first workpiece relative to reference site(s) can include measuring the top surface at three locations. The method can also include measuring the top surface of a second workpiece relative to the reference site(s) at one or more measurement locations; and verifying (i) that the first shim level was correctly calculated, and (ii) that the first set of shims were correctly arranged on top of the top surface of the first workpiece, by comparing the measurement of the top surface of the first workpiece and the first shim level to the measurement of the top surface of the second workpiece.

Implementations may include one or more of the following features. For example, the top surface of the rack can be measured relative to at least one reference site. A preliminary shim level can be calculated. A preliminary set of shims can be arranged on top of the top surface of the rack, where the preliminary set of shims can be arranged according to the preliminary shim level. The position of a stone slab can be determined relative to a reference site using a measuring device Implementations may also include one or more of the following features. For example, the method can also include measuring the top surface of a second workpiece relative to reference site(s); calculating a second shim level, where the second shim level calculation can include the measurement of the top surface of the second workpiece and the location of at least one of the stone cutting elements; arranging a second set of shims on top of the top surface of the second workpiece, where the second set of shims can be arranged according to the second shim level; and placing a third workpiece on the rack in a horizontal orientation, where the third workpiece can be placed on top of the second set of shims.

Implementations may also include one or more of the following features. For example, the first set of shims can include one single shim. The location of at least one of the plurality of stone cutting elements can be adapted to include consideration of the first shim level. The method can also include a first step of establishing a reference site on the rack. The step of calculating a first shim level can also include consideration of the measurement of the top surface of the first workpiece and the location of at least one of the stone cutting elements.

Implementations may include the following features. For example, the method can also include securing the stack of workpieces in a fixed position on the rack; rotating the rack, with the workpieces, to a vertical orientation; placing the rack in the cutting machine with each stone slab in relative alignment with one cutting element; and cutting each slab to create two stone laminate panels.

Implementations may also include the following features. For example, the substrate bonded to the first face of a stone slab can be a honeycomb substrate, and the substrate bonded to the second face of a stone slab can be a honeycomb substrate. A measurement device can be used to measure the top surface of a workpiece relative to a reference site. Measuring the top surface of a workpiece can comprise determining the position of a center of the edge of the stone slab of each workpiece.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 3:
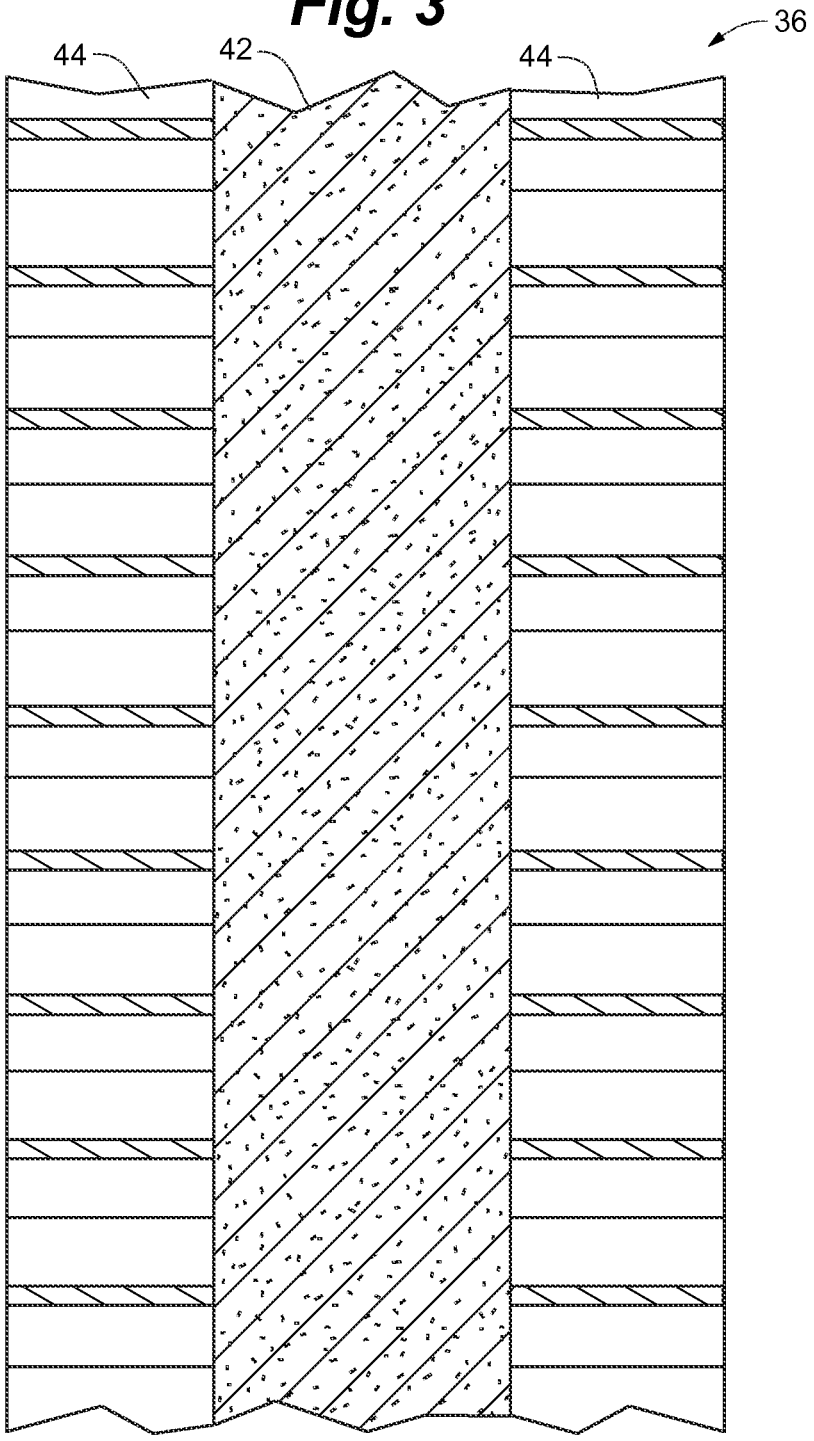
FIG. 3 is an illustrative edge view of a sandwich panel, according to some embodiments.

A workpiece consisting of a sandwich panel 36 is depicted in FIG. 3 in an edge view, according to some embodiments. The sandwich panel 36 can include a stone slab 42 and two substrates 44 (which can be honeycomb substrates, or other substrates). As detailed elsewhere herein, the stone slab 42 can have two parallel faces and one or more edges. The substrates 44 can be bonded to each side of the stone slab 42 to create the sandwich panel 36. Stone slabs and the substrates can have a rectangular profile. However, it will be understood that sandwich panel 36 may be provided with other profiles (circular, quadrilateral, triangular, polygonal, a profile with one or more curved edges, or an irregularly shaped profile, etc.) and the sandwich panel profile can depend on the intended application. Starting from a workpiece consisting of a sandwich panel 36, a cut can be made through approximately the center of the stone slab 42, to cut the sandwich panel 36 in two, and produce two stone laminate panels of approximately uniform thickness. The result is that each of the two stone laminate panels will have a stone veneer which remains bonded to the substrate. Panels with stone veneers of different thicknesses can be cut by moving the alignment of cutting elements to off-center. A thicker stone slab than usual may be used in this instance.

Figure 4:
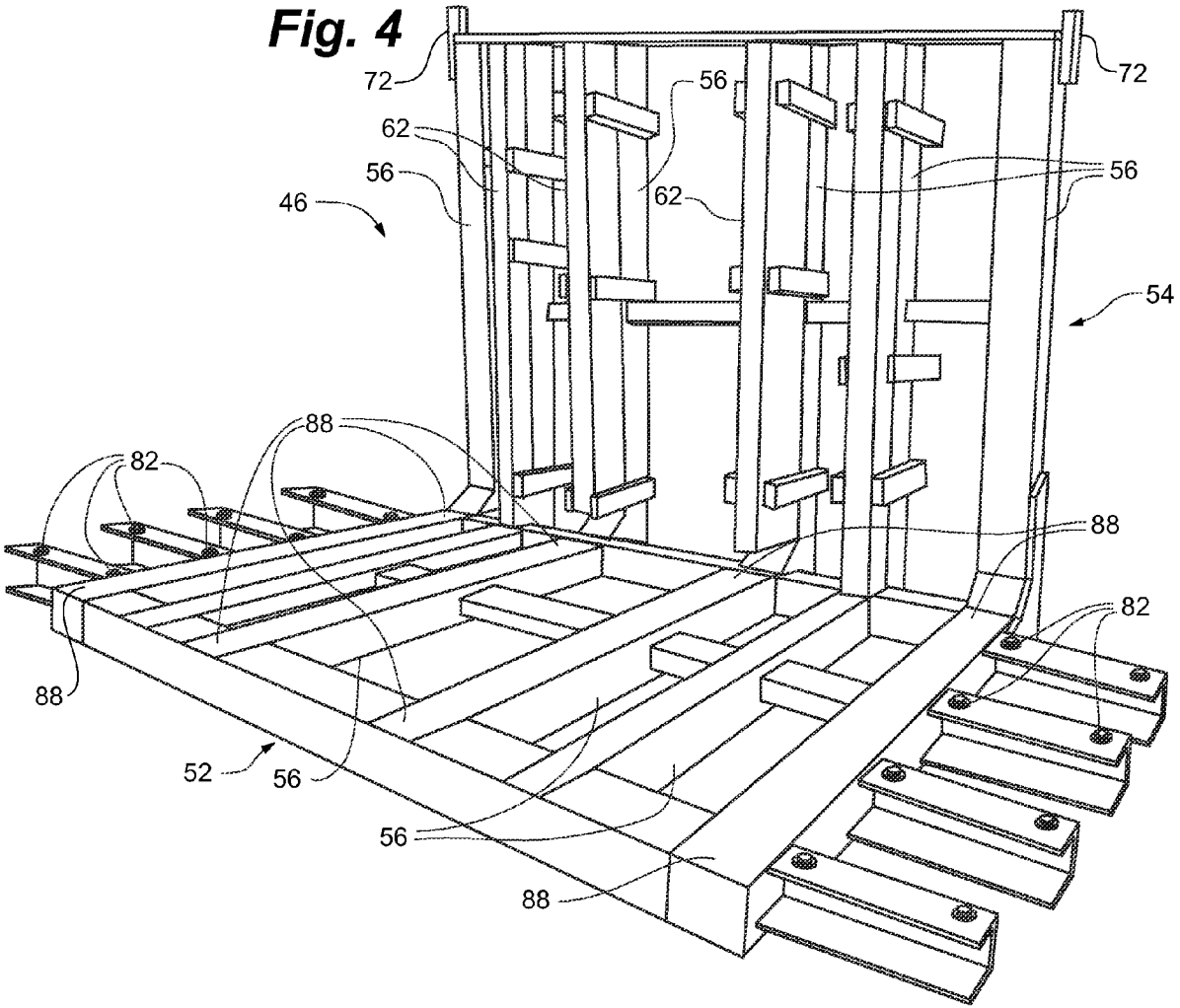
FIG. 4 is a perspective view of a rack in a loading position, according to some embodiments.

FIG. 4 is a front perspective view of a rack 46, in accordance with some embodiments. The rack 46 can have a base 52 and a side wall 54. The base 52 can be comprised of a framework of members 56 that provides a base surface that can be used to support one or more sandwich panels 36. As depicted in FIG. 4, the base 52 of the rack 46 is in a horizontal orientation or loading position, and the side wall 54 is in a vertical orientation, such that the rack can be resting on a factory floor with the base 52 in contact with the floor. The side wall 54 also can be comprised of a framework of members 56 that provides a side surface. The side surface and the base surface can be joined so that the side surface forms a right angle to the base surface. The base and side surfaces are support surfaces. The framework members can be flat and/or level as they form the surface on which sandwich panels will be loaded or stacked. Similarly, the edge of the sandwich panels will rest on the side surface when the rack is rotated 90 degrees for transport and/or into cutting position, as will be described in greater detail below. A top enclosure can serve to help secure a stack of sandwich panels on the rack. The rack 46 can be fabricated from a metal, so that the rack can rigidly support a substantial mass of stone, with minimal flexing during transportation and cutting operations. Sacrificial beams 62, which can be made of wood, can be attached to the side wall 54. As depicted in FIG. 4, the rack 46 is in a loading position.

Figure 5A:
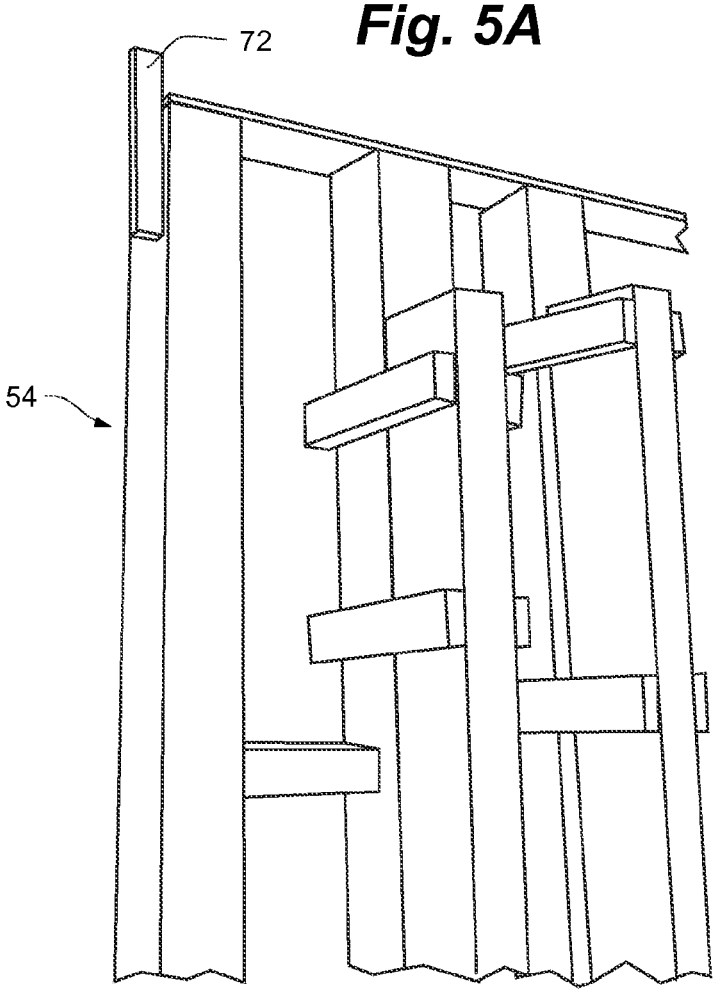
FIG. 5A is a perspective view of a top closure, according to some embodiments.

FIG. 5A is a side perspective view of a top closure 64, in accordance with some embodiments. The top closure 64 can be comprised of a framework of members 56 that together can provide a supporting surface. The top closure 64 can also have two clamps 66, one on each of the right and left hand sides of the top closure 64, as depicted. The top closure 64 can be provided in other forms and secured to the rack by other mechanisms known to those skilled in the art.

According to some embodiments, an attachment point 72 can be located on the top left hand side, of the side wall 54, as shown in FIG. 4. Similarly, a second attachment point 72 can also be located on the top right hand side, of the side wall 54. The top closure 64 can be hoisted and mounted to the top of side wall 54 of the rack 46. For mounting, the clamps 66 can work cooperatively with the attachment points 72. Additional supports can also be used to mount the top closure 64 to the side wall 54.

Figure 1:
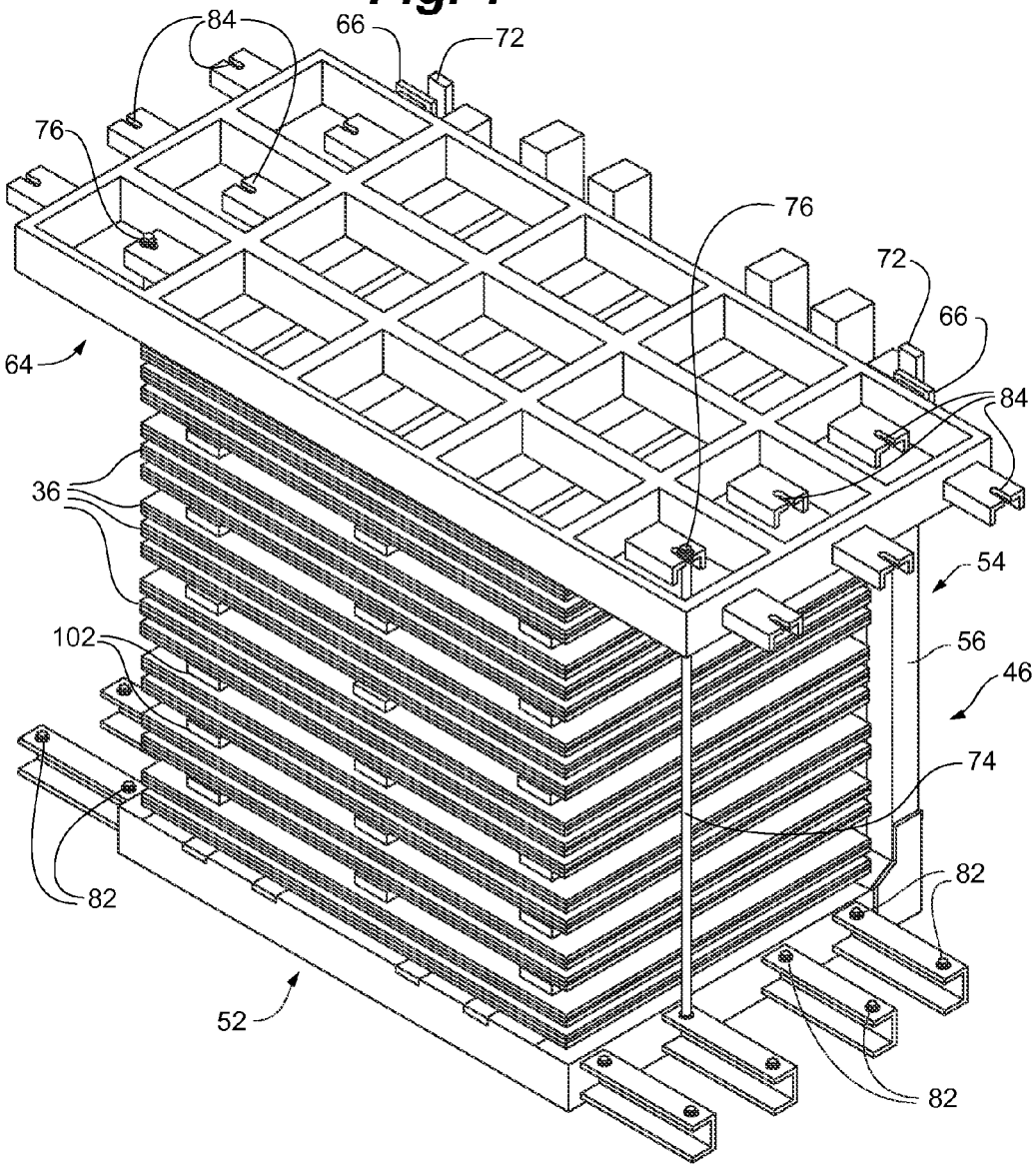
FIG. 1 is a perspective view of a loaded rack, according to some embodiments.
Figure 5B:
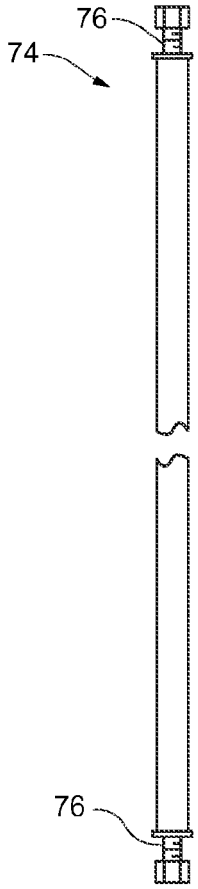
FIG. 5B is a front view of a pole, according to some embodiments.

FIG. 1 depicts a front perspective view of a rack 46 with a plurality of sandwich panels 36 stacked on the base 52 of the rack, according to some embodiments. As shown in FIG. 1, the top closure 64 has been hoisted and mounted to the top of side wall 54. To secure the top closure 64 to the rack 46, the two clamps 66 of the top closure 64 can be fastened to the pair of attachment points 72 of the side wall 54. Additional supports can also work to secure the top closure 64 to the rack 46. For example, one or more poles 74 can be used. Depicted in greater detail in FIG. 5B, each pole 74 can have a pair of couplings 76, which can be located at either end of the pole. One coupling 76 can be inserted into a fastening hole 82 that can be located in the base 52 of rack 46, while the other coupling 76 can be inserted into a corresponding notch 84 which can be located in the top closure 64. Once engaged, the couplings 76 can be tightened.

As depicted in FIG. 1, a pair of poles 74 can secure the top closure 64 to the rack 46, according to some embodiments. Of course, depending on the configuration of the rack 46 and of the top closure 64, additional poles 74 can be used. In the embodiment depicted in FIG. 1, five additional notches 84 are available on each side of the top closure 64, which can be used as additional attachment positions (five on the right hand side, and five on the left hand side). As can be seen, there are seven additional fastening holes 82 on the right hand side of the base 52 of the rack 46. Of these seven fastening holes 82, five correspond with the additional notches 84 on the right hand side of the top closure 64, and accordingly, up to five additional poles 74 can be used to secure the right hand side of the top closure to the rack 46, if so desired. As can be seen from FIG. 4, the pattern of fastening holes 82 can also be repeated on the left hand side of the rack 46, such that an additional five poles 74 can also be used to secure the left hand side of the top closure to the rack 46, if desired. In some embodiments, additional and/or substitute supports can be used to secure the rack and top closure, depending on the configuration of the rack and/or the top closure. In some embodiments, sandwich panels may be secured in position on the rack by other fasteners or other securing systems known to those skilled in the art.

Figure 2:
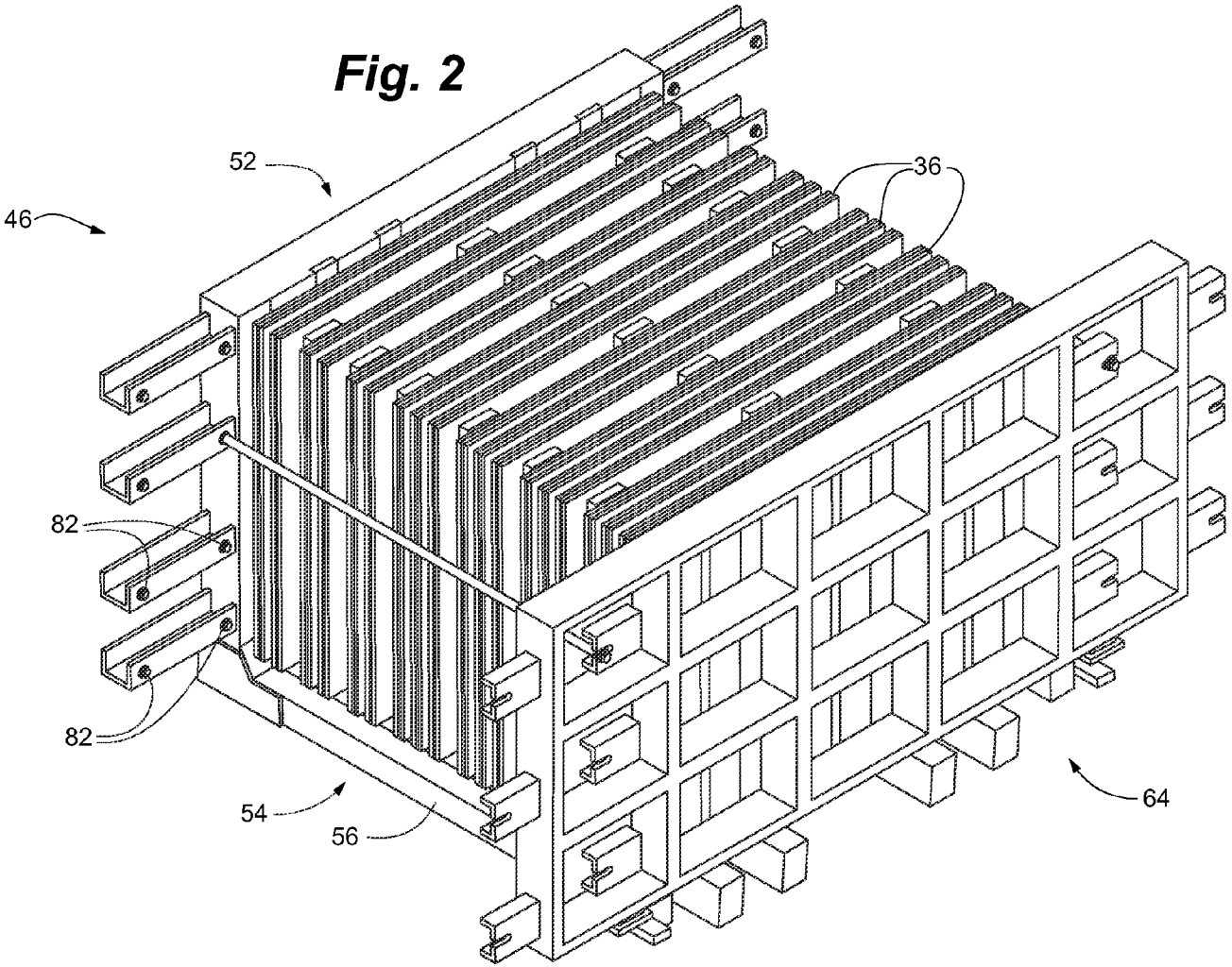
FIG. 2 is a perspective view of a loaded rack in a cutting position, according to some embodiments.

According to some embodiments, the rack 46 can be rotated, such that the side wall 54 is in a horizontal orientation, and the base 52, as well as the top closure 64 are in a vertical orientation, as depicted in FIG. 2. In this position, the side wall 54 can now be the main contact surface of the rack with a factory floor. As depicted in FIG. 2, the rack 46 is in a cutting position. As can be seen, rotating the rack 46 from the loading position depicted in FIG. 4 (or from the loaded position depicted in FIG. 1) to the cutting position of FIG. 2, has also rotated the stacked sandwich panels 36, such that an edge of each sandwich panel 36 is now facing up. As the top closure 64 can be securely fastened to the rack 46, when the rack 46 is still in the loading position, any movement of the stacked sandwich panels 36 relative to the rack 46—due to the rotation of the rack 46 from the loading to the cutting position—can be either minimized, or altogether eliminated.

In the loading position, as depicted in FIG. 4, the rack 46 can be configured to accept a plurality of workpieces that can be placed in a horizontal orientation on the base 52, in accordance with some embodiments. One or more reference sites 88 can be established on the rack, and each of the reference sites 88 can have a known position relative to, for example, the furthest possible outboard stone cutting element location when the rack is rotated into the cutting position, and placed in alignment with a stone cutting machine. In some embodiments, each of the reference sites 88 can be polished to a smooth and reflective surface.

According to some embodiments, a method of preparing a plurality of workpieces for subsequent concurrent cutting is disclosed. The method can include positioning the plurality of workpieces on a rack. Each workpiece can be placed horizontally on the rack, and on top of each workpiece, a set of shims can be placed. A set of shims can include one single shim. A set of shims can also include more than one shim (for example, a set of shims can be a plurality of shims). A set of shims can be used to compensate for variations in workpiece thickness and/or the set of shims can be used to position each of the workpieces with one edge of each stone slab in relative alignment with a stone cutting element of a stone cutting machine. In this manner, the workpieces can be stacked on the rack and secured to the rack (with, for example, a top closure), and the rack can then be rotated to a cutting position. This places the workpieces in a vertical orientation for cutting.

Figure 6:
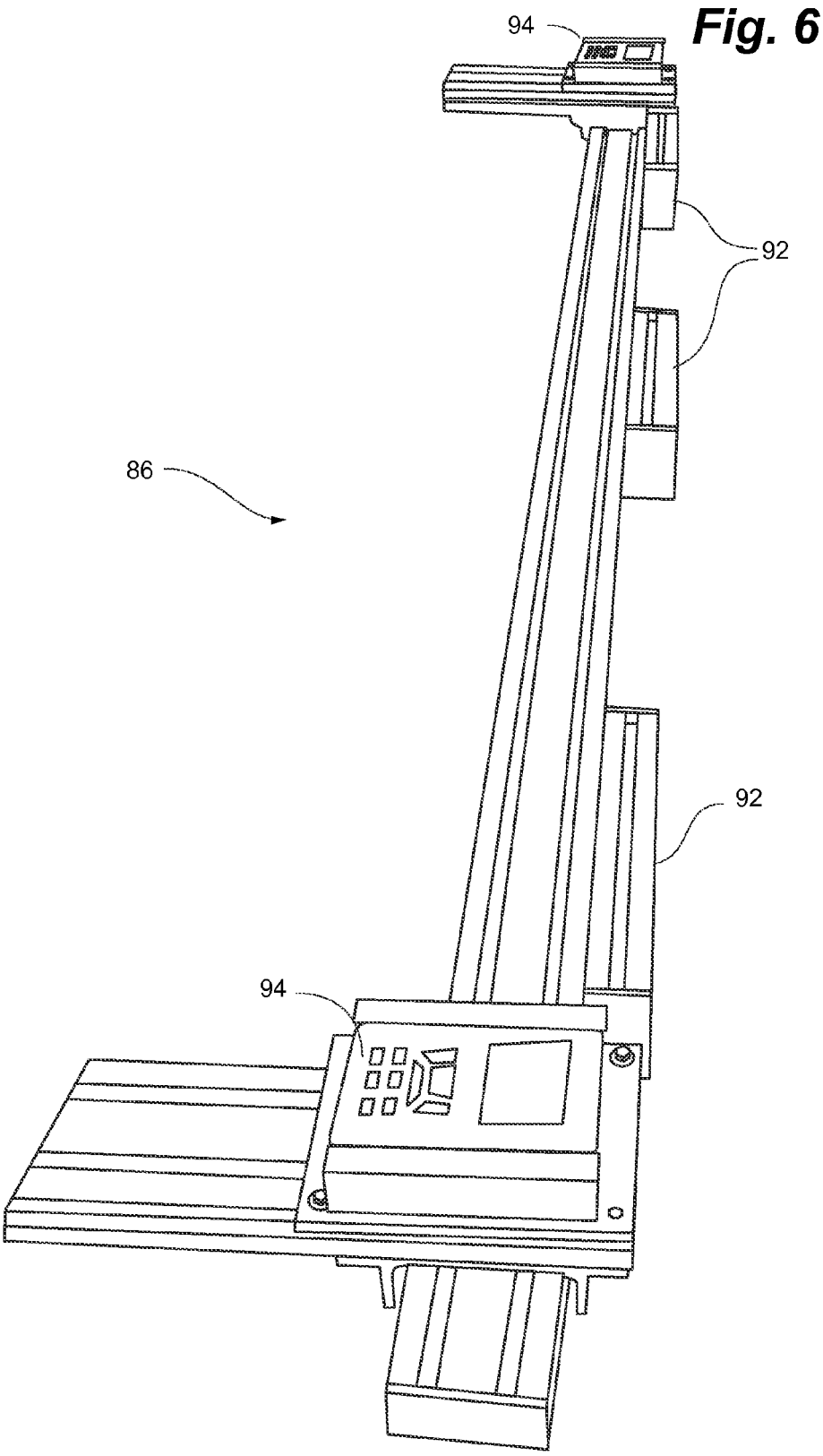
FIG. 6 is a perspective view of a measurement gauge, according to some embodiments.

FIG. 6 is a side perspective view of a measurement gauge 86 that can be used, in accordance with some embodiments, to measure the top surface of a workpiece. The measurement gauge 86 has three surface pads 92 that can rest on the object being measured. The measurement gauge 86 can have two laser measurement devices 94, one at each end of the measurement gauge 86. Each of the two laser measurement devices 94 can be used to measure the distance from the device to a reflective reference site. In this manner, the distance from the three surface pads, and thus the top surface of the workpiece being measured, relative to the reference site can be determined.

Figure 7A:
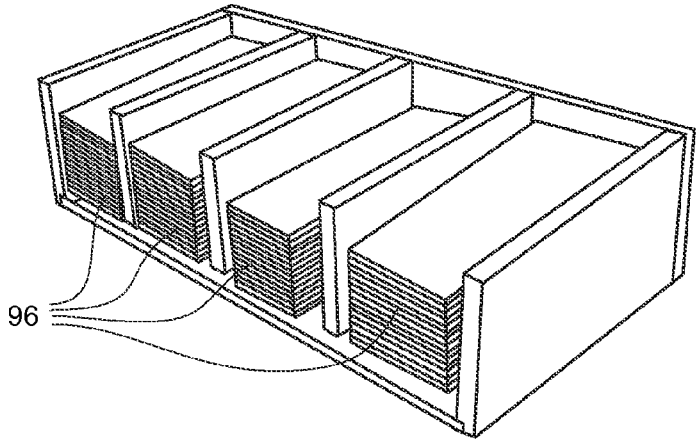
FIG. 7A is a perspective view of skinny shims arranged in a tray, according to some embodiments.
Figure 7B:
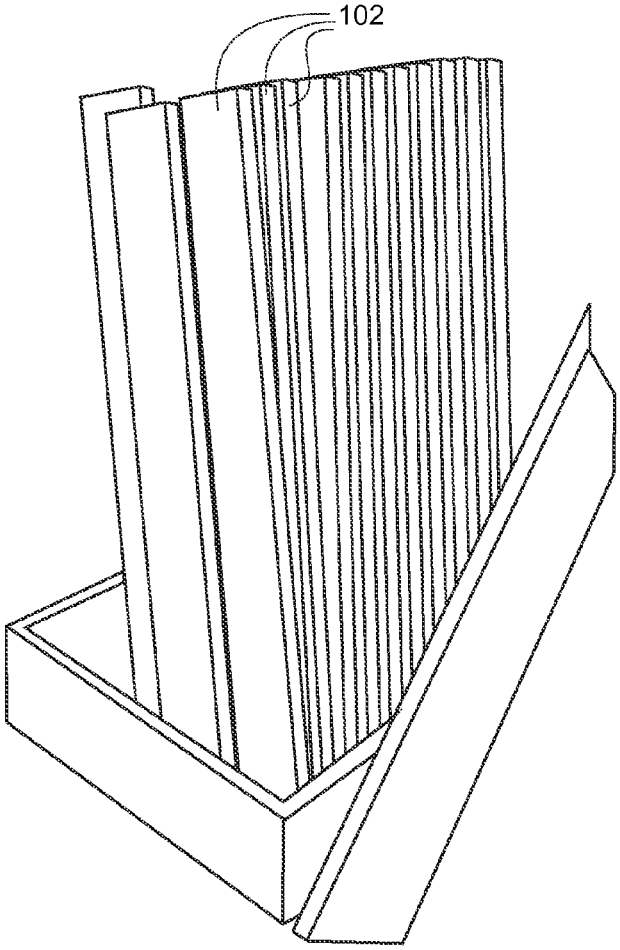
FIG. 7B is a perspective view of thick shims arranged in a stand, according to some embodiments.

FIGS. 7A and 7B are perspective views of skinny shims 96 and thick shims 102, that may be used in accordance with some embodiments Skinny shims 96 can come in a variety of thicknesses, which can include, for example, 0.1 millimeters, 0.25 millimeters, 0.5 millimeters, and 1.0 millimeter thick Skinny shims 96 can be color coded, where each color can correspond to one particular thickness of the shims. Each skinny shim 96 can be an approximately 3×12 inch sheet of plastic. Thick shims 102 can come in a variety of thickness, which can include, for example, ⅛", ¼" and ½" thick. Each thick shim 102 can be an approximately 4×48 inch plastic plank. The shims described herein are merely examples. Of course, shims can be provided in any of a variety of thicknesses, sizes and methods of identifying the shim, and combinations thereof, as may be appropriate depending upon various factors such as dimensions of the rack or required spacing adjustments.

Measuring a surface can include measuring a number of parameters. Such parameters can include flatness or level which can be defined as the allowable deviation of a surface from a defined reference plane. This can include a surface that has an incline relative to the defined reference plane, such that one edge of the surface exceeds the allowable deviation from the reference plane. In the context of a surface that is produced by machining and/or other manufacturing methods, geometric irregularities generated by the machining method can contribute to a surface's flatness or level. Two such geometric irregularities can include roughness and waviness. Roughness can consist of fine irregularities in the surface which can be the product of the machining process. Waviness can be a widely spaced component of surface irregularity, and the spacing of waviness can be in the order of several magnitudes greater than the spacing of roughness. The use of shims allows for correction or compensation for surface irregularities and proper positioning and/or alignment of stone slabs of workpieces with cutting elements and/or cutting planes.

According to some embodiments, a plurality of sandwich panels can be placed on a rack to prepare for concurrent cutting of the sandwich panels. The process can start by checking the surface of the framework of members that comprise the base of a rack. In some embodiments, this can be considered a calibration check of the tooling. A measurement gauge can be placed on top of the surface of the base of the rack, such that the two laser measurement devices can reflect from a pair of reference sites. An operator can then verify that the three surface pads are in contact with the top of the surface of the base of the rack. This verification can be accomplished visually, or shims can be used, according to, for example, the following procedure: An operator can attempt to place shims under each of the three surface pads, one at a time. This process can start with the operator selecting the thinnest shim first. The goal can be to fit a shim, or a stack of shims, which can be any combination of thicknesses, under a surface pad, continuing until the remaining gap between the surface pad of the measurement gauge and the top surface of stack of shims will not permit an additional thinnest shim from fitting without moving the measurement gauge. The procedure can then be replicated for the remaining two surface pads. Of course it can be the case that no shims will fit under one, two or all three of the surface pads. Once all three surface pads are in contact, either directly with the rack's surface, or the pads are in contact with a stack of shims, then the operator can record the readings of the two laser measurement devices. The operator can move the measurement gauge to the next pair of reference sites, to repeat the process, until all pairs of reference sites have been used.

As described elsewhere herein, the locations of the reference sites can have a known position relative to a stone cutting element location when the rack is rotated into the cutting position and placed in alignment with a stone cutting machine. As a stone cutting element will cut stone along a cutting plane, the position of each reference site relative to a stone cutting element can include a relative planar orientation of the reference site with respect to the cutting element's cutting plane. Alignment of a sandwich panel with a stone cutting element can include alignment of an edge of the sandwich panel with the stone cutting element, as well as alignment of the sandwich panel with the cutting element's cutting plane.

The thickness of a first sandwich panel (i.e. the first workpiece) can be determined. As a result, the height of a stack of shims that is required to position the first sandwich panel in alignment with a stone cutting element can be calculated for each reference site, according to some embodiments. Stacks of shims can then be placed as necessary, according to the calculated shim level, so that when the first sandwich panel is placed on the set of shims, the first sandwich panel will be aligned with a stone cutting element, such that the stone cutting element can cut the sandwich panel in two. Of course, this calculation and shim placement can be combined with the tooling calibration of the rack (if one is required), into a single procedure in order to reduce the required steps for placing a first workpiece on the rack. It can also be the case that, according to the calculated shim level, no shims will be required at one or more locations of the rack.

According to some embodiments, each sandwich panel can be aligned with a stone cutting element, such that as the stone cutting element cuts through each sandwich panel, the sandwich panel is cut in two. As described elsewhere herein, depending on the stone cutting machine to be used, the positioning of a stone cutting element may be restricted to increments according to the step-width of a machine (for example, the distance between adjacent grooves on a drum). Thus, according to some embodiments, shims can be used for one, or both, of two purposes: (1) to position a sandwich panel so that it can be correctly located for cutting, according to the next available step-width adjustment of one of the stone cutting elements, and (2) to compensate for any surface irregularities of the rack or of the preceding sandwich panel that has been stacked on the rack (for example, waviness of the surface, or a surface that is inclined relative to the cutting element's cutting plane. As stone slabs, that are contained within the sandwich panels, can be as thin as 2 centimeters, as wide as 12 feet, and as high as 6 feet. Accurate control over the position of the cutting plane relative to the center of the stone slab, through adjustment of the shim level, can be important for obtaining desired results, i.e., producing laminate panels with stone veneers of different, or approximately equal, thicknesses. In some embodiments, adjustment to within ±0.1 millimeters for the shim level between each sandwich panel, can be set as the goal for obtaining a desired dimensional tolerance for the finished stone laminate panels.

According to some embodiments, a method for sequentially (a) measuring the top surface of each workpiece relative to one or more reference sites after horizontal placement of the workpiece in position on the rack, (b) calculating a shim level for the workpiece, and (c) arranging a set of shims on the top surface of the workpiece, which can be at one or more shim sites, according to the shim level for the workpiece, will now be described.

A first workpiece can be placed in position on a rack. Using a measurement gauge, an operator can measure the top surface of the first workpiece relative to one or more reference sites, which can be polished to have reflective surfaces. The measurement gauge can be placed on the workpiece, such that the three surface pads are resting on the top surface of the workpiece, and the two laser measurement devices are each aligned with a reference site. The readings from the two laser measurement devices can then be recorded. Recording the readings can include writing down the readings on a chart, entering the readings into a computing device, such as a computer, a tablet or other hand-held computing device, or through the use of a direct connection from the measurement gauge directly to a computing device.

The measurement gauge can then be moved to a next position on the top surface of the workpiece, such that the three surface pads are resting on the top surface of the workpiece, and the two laser measurement devices are each aligned with a next pair of reference sites. These readings are recorded and the procedure is repeated for all remaining pairs of reference sites.

The thickness of a second workpiece can then be measured.

A shim level can then be calculated. The shim level calculation can include: (A) The readings from the two laser measurement devices of the measurement gauge for each pair of reference sites. These readings can provide information regarding the flatness of the top surface of the first workpiece, which can include information regarding any inclination that may exist between the top surface of the first workpiece, and the horizontal plane and/or a cutting plane, as indicated by the reference sites. (B) The position of the next available stone cutting element location (for example, the distance to the next groove on the drum of a stone cutting machine). (C) The thickness of the second workpiece.

The shim level calculation can be automated through the use of a computer program, or it can be accomplished manually. Once calculated, the shim level information can include the height of each shim stack that would need to be placed, at one or more shim sites, on top of the first workpiece. The locations of these shim stacks can correspond with the locations of the three surface pads of the measurement gauge, when the measurements were taken.

Figure 8:
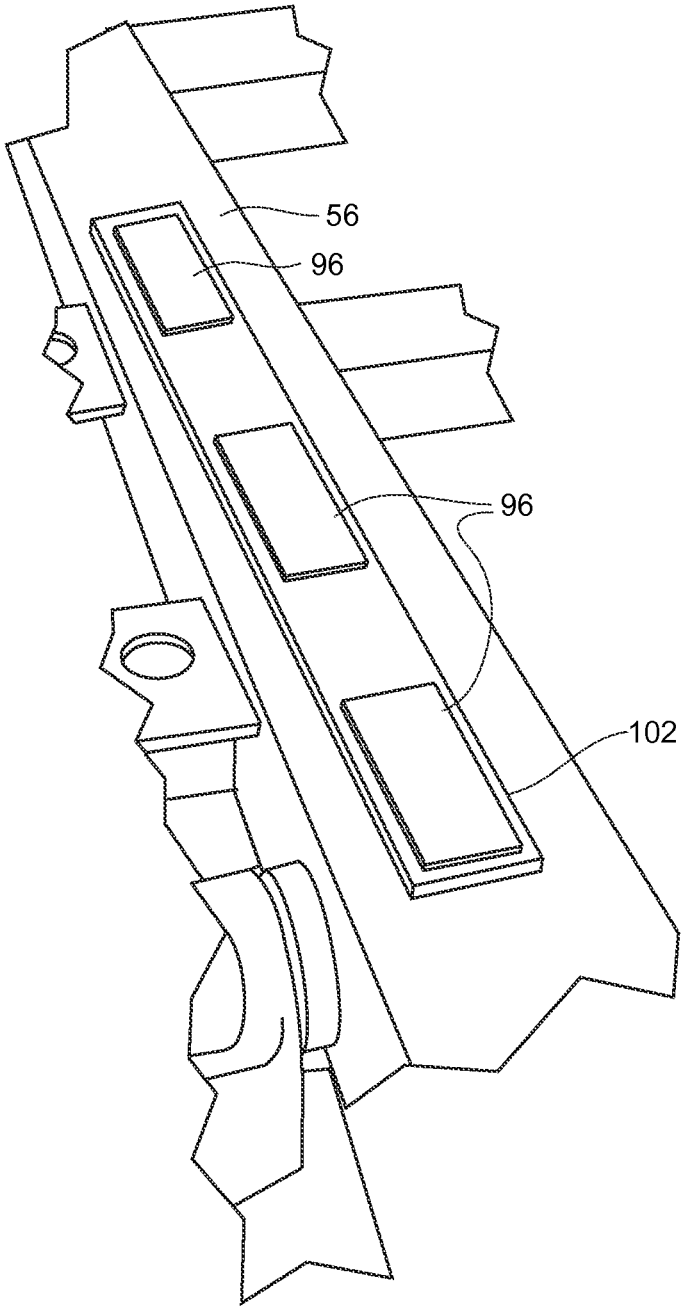
FIG. 8 is a perspective view of a member of the rack of FIG. 4, with a thick shim and three skinny shims placed on the member, according to some embodiments.

In accordance with the shim level, thick shims and/or skinny shims (or no shims) can then be placed at the one or more shim sites. According to some embodiments, the shim site locations can be as depicted in FIG. 8, which shows one of the members 56 of the base with a thick shim 102, and three skinny shims 96 placed on the member 56, as an example of where the shims can be located. Other shims can be likewise placed, so that a first set of shims can be arranged on top of the top surface of the first workpiece. The first set of shims can thus be arranged according to the first shim level as calculated.

The second workpiece can then be placed on top of the first set of shims. The measurement process can then be repeated for the second workpiece. An operator can measure the top surface of the second workpiece, relative to the one or more reference sites. For the second workpiece, the measurements can be used for two purposes: calculating a second shim level, and verifying that the first set of shims were correctly calculated and placed.

The overall process can thus be repeated. For the stone cutting machine depicted in FIG. 9, up to 30 sandwich panels can be stacked for concurrent cutting. If the number of sandwich panels, that are desired to be cut, are less that can be accommodated by the rack, blank panels (e.g., plain honeycomb panels) or other place holders, such as stacks of shims, can be used to fill the rack, such that the sandwich panels are secured when the rack is rotated for cutting.

In the foregoing discussion, measurements are described as being taken with the measurement gauge depicted in FIG. 6. However, the measurement step can be carried out by any measurement device or technique, including measurement by hand, for example using a ruler. A measurement device can also include, for example, a stadiometer (including a digital and/or laser stadiometer), a micrometer, a caliper, a depth gauge, or a height gauge (which can include using a digital micrometer, a digital caliper, a digital depth gauge, or a digital height gauge). Measurements can also be taken with a different gauge or measurement system or device, with the measurements either taken by hand, or by some level of automation. A system of laser measurement devices can also be used. Such a system can be mounted or positioned at the rack loading area, at a fixed location (e.g., on stands, poles, walls, or the like) and can be configured to automatically measure and capture the desired surface information. Such measurement devices can be used without a need for repeated movement of a gauge. Other measurement devices and/or techniques, as will be apparent to one skilled in the art, are also considered as being within the intent, scope and spirit of the instant disclosure.

The need for proper positioning of each workpiece in the stack may be better understood in the context of the configuration and operation of stone cutting machines.

In stone processing operations, gang saws or multi-wire diamond machines can be used to concurrently cut multiple stone slabs from a single stone block. Such stone cutting machines can have a plurality of stone cutting elements, and each one of the stone cutting elements can be configured to cut through stone, such that the stone cutting machine as a whole can be configured to concurrently create a plurality of stone cuts. Accordingly, some stone cutting machines can concurrently create multiple stone slabs from a single stone block.

Depending on the manufacturer, such stone cutting machines can have from 2 to 130 or more stone cutting elements. For example, some stone cutting machines can have 5, 32, 70, 72, 80 or 133 stone cutting elements. Again, depending on the manufacturer, type of machine and type of cutter, some machines can take 8-72 hours to complete a multi-cut pass through a stone block. Stone cutting machines can use, for example, either a stone cutting blade, or a wire as the stone cutting element.

Stone cutting machines can utilize either a rotating or a reciprocating stone cutting blade. For such machines, a motor can move the blades in either a rotating or reciprocating motion to engage with, and cut, a stone block. A cutting fluid, which can be water, can be used to cool the blades, and the cutting fluid can be used to help remove the swarf. In most machines, the blades can be repositioned during the machine set-up such that multiple stone slab thicknesses can be concurrently cut. For example, several 2 centimeter thick and several 3 centimeter thick stone slabs could be concurrently cut from a stone block. In some machines, one or more blades can be removed, such that if the machine were set up to cut 2 centimeter stone slabs, 4 centimeter, 6 centimeter and 8 centimeter stone slabs, for example, could also be concurrently cut by removing 1, 2 or 3 blades that would otherwise be adjacent one to the other. Of course, some machines can include both of these features, such that blades can be repositioned, as well as removed, providing further stone slab cutting options.

Figure 9:
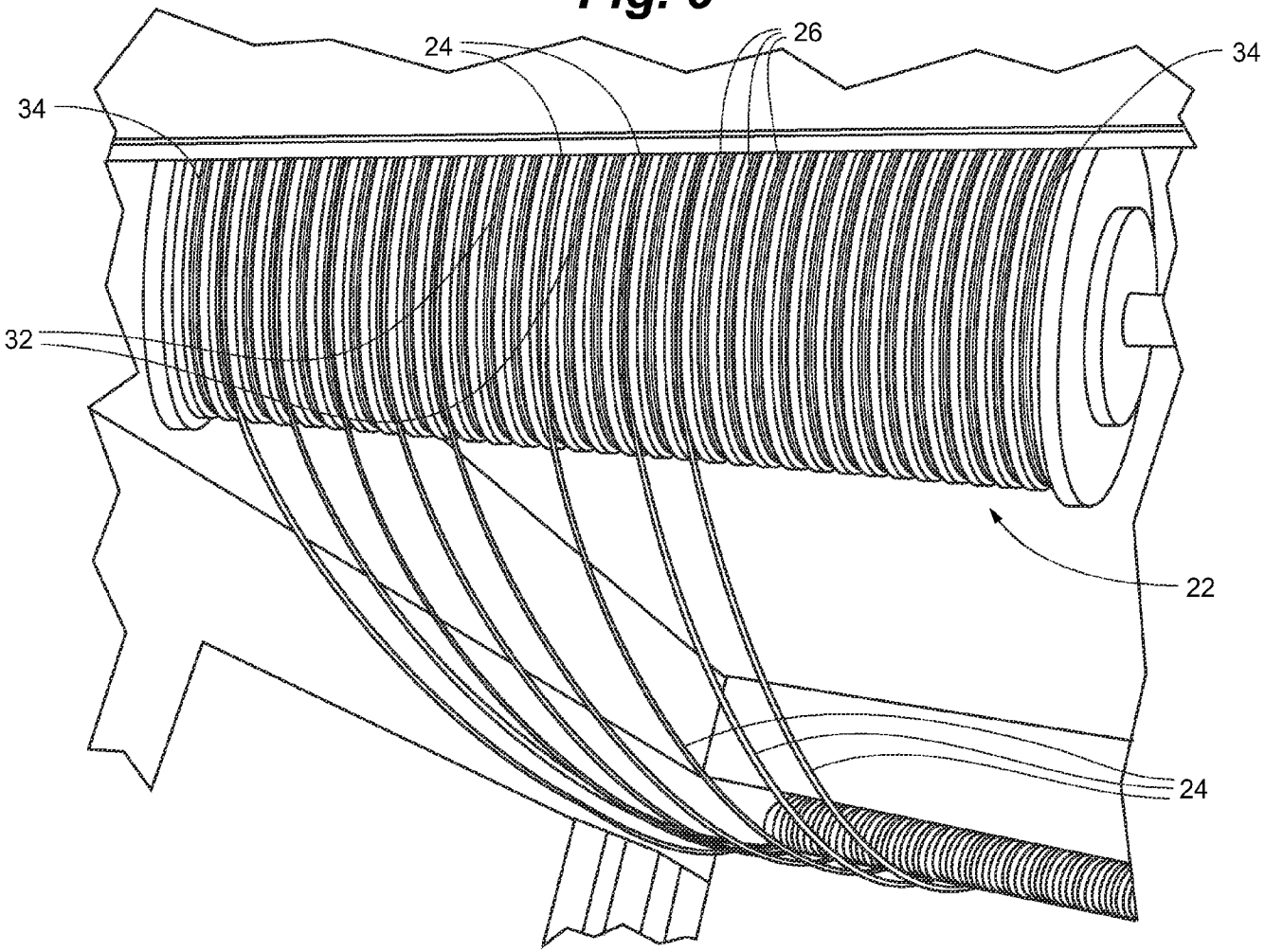
FIG. 9 is a perspective view, looking up at an illustrative drum and cutting wires of a stone cutting machine.

Stone cutting machines can also use a wire as the stone cutting element. For such machines, a motor can typically move one or more drums which can then move the cutting wires. FIG. 9 depicts the drum 22 and multiple cutting wires 24 of one such stone cutting machine. A cutting fluid, which can be water, can be used to cool the cutting wires, and the cutting fluid can be used to help remove the swarf. In some machines, the cutting wires can be repositioned, or removed, during the machine set-up such that multiple stone slab thicknesses can be concurrently cut. As can be seen from FIG. 9, the drum 22 can have multiple grooves 26 that can be configured to guide the cutting wires. Depending on the machine, the grooves 26 on the drum 22 can be positioned with one groove every 1, 2 or 3 centimeters, for example. As shown on the right hand side of drum 22, the cutting wires can be removed from the drum, and as shown on the left hand side of the drum 22, the cutting wires can be positioned so that there is one wire every several grooves. In the example depicted, a repeating pattern of three grooves can be seen in the center portion of the drum. The first of the three grooves has a wire 24, the next two grooves 32 do not have wires. The pattern then repeats, such that the next groove has a wire 24, and so forth. In some situations, a repeating pattern may not be appropriate, and wires are placed where needed without regard to a pattern. In these manners, stone slabs of a desired width can be concurrently cut.

For the stone cutting machine shown in FIG. 9, grooves 34 indicate the furthest possible outboard stone cutting element locations. For this machine, these locations correspond with the grooves that are the furthest to the right hand side of the machine, as well as the left hand side of the machine.

As can be appreciated, stone slab widths cut on the machine depicted in FIG. 9, are limited in several ways. The minimum width for a cut stone slab is limited by the adjacent groove-to-groove distance, such that if the grooves are 2 centimeters apart, then the thinnest stone stab that can be cut is 2 centimeters, minus the width of stone that a cutting wire removes when cutting the stone. In addition, stone slab widths can only be increased by one or more step-width(s). The step-width for a particular machine corresponds to the distance between adjacent grooves on the drum. That is, wires cannot be placed between grooves on a drum; wire cutters can only be either be moved to a groove or repositioned away from a groove. In a similar manner, stone cutting machines that use stone cutting blades also have a step width, such that stone slab widths can only be increased by one or more step-width(s).

It may be anticipated that stone cutting machines may be developed that do not have a step-width limitation. Such machines may have a drum with movable grooves that are incorporated into the drum design. Accordingly, stone slab thickness cut on such machines could be increased, starting from a minimum thickness and increasing in much smaller increments, for example, in increments of 0.5 millimeters.

Stone cutting machines can incorporate two directions of motion in order to cut stone. First, the stone cutting elements can move across the stone face that is being cut (either back and forth, or in one direction, for closed loop wire cutters). Second, the stone cutting elements can have a relative motion from a starting point above the stone block downwards to the bottom of the stone block to vertically cut the block. Some machines move the stone cutting elements downwards into the stone block, other machines move the stone upwards towards the stone cutting elements.

Stone cutting machines can use a rack or carriage that can be used to secure a stone block during cutting operations. A rack can be configured to operate cooperatively with a stone cutting machine. Such cooperation can include the use of known reference sites on the rack, which can be helpful in optimizing the number and/or quality of stone slabs that can be cut from a stone block.

For example, one or more reference sites can correspond with the furthest possible outboard stone cutting element location on the right hand side of the machine, and one or more other reference sites can correspond with the furthest possible outboard stone cutting element location on the left hand side of the machine. Such reference sites can be used to locate the position of the most outboard cut that could be made, if a stone cutting element is positioned in the corresponding location of the stone cutting machine's drum. Of course, some rack and stone cutting machine combinations may not have any reference sites.

In the foregoing detailed description, the invention has been described with reference to specific embodiments. However, it may be appreciated that various modifications and changes can be made without departing from the scope of the invention as set forth in the appended claims.

The invention claimed is:

1. A method of preparing a plurality of workpieces for concurrent cutting using a stone cutting machine; the stone cutting machine having a plurality of stone cutting elements and being configured to concurrently create a plurality of stone cuts; the method comprising the steps of:

providing a plurality of workpieces, each of the plurality of workpieces comprising (i) a stone slab having two parallel faces and one or more edges, (ii) a substrate bonded to a first face of the stone slab, and (iii) a substrate bonded to a second face of the stone slab, each workpiece having a top surface when positioned in a horizontal orientation; and positioning the plurality of workpieces as a stack of workpieces to position each of the workpieces with one edge of each stone slab in relative alignment with one of the stone cutting elements, wherein the positioning step comprises:

(a) placing a first workpiece on a rack in a horizontal orientation, the rack configured to accept a plurality of workpieces in a horizontal orientation and to present the stack of workpieces in a vertical orientation for cutting;

(b) measuring the top surface of the first workpiece relative to a reference site;

(c) calculating a first shim level;

(d) arranging a first set of shims on top of the top surface of the first workpiece, the first set of shims arranged according to the first shim level; and (e) placing a second workpiece on the rack in a horizontal orientation, the second workpiece placed on top of the first set of shims.

2. The method of claim 1, wherein measuring the top surface of the first workpiece relative to a reference site comprises measuring the top surface of the first workpiece at three locations.

3. The method of claim 1, further comprising the steps of:

(f) measuring the top surface of the second workpiece relative to the reference site at one or more measurement locations; and (g) verifying (i) that the first shim level was correctly calculated, and (ii) that the first set of shims were correctly arranged on top of the top surface of the first workpiece, by comparing the measurement of the top surface of the first workpiece and the first shim level with the measurement of the top surface of the second workpiece.

4. The method of claim 1, wherein the step of calculating the first shim level comprises calculating a first shim level, the first shim level being a calculation including (i) the measurement of the top surface of the first workpiece and (ii) the position of at least one of the plurality of stone cutting elements.

5. The method of claim 1, further comprising the steps of:

(f) measuring the top surface of the second workpiece relative to the reference site;

(g) calculating a second shim level, the second shim level being a calculation including the measurement of the top surface of the second workpiece and the position of at least one of the plurality of stone cutting elements;

(h) arranging a second set of shims on top of the top surface of the second workpiece, the second set of shims arranged according to the second shim level;

(i) placing a third workpiece on the rack in a horizontal orientation, the third workpiece placed on top of the second set of shims.

6. The method of claim 1, wherein the plurality of workpieces are stacked so the position of at least one of the plurality of stone cutting elements is adapted to include consideration of the first shim level.

7. The method of claim 1, further comprising the initial steps of:

measuring the top surface of the rack relative to at least one reference site;

calculating a preliminary shim level; and arranging a preliminary set of shims on top of the top surface of the rack, the preliminary set of shims arranged according to the preliminary shim level.

8. A method of preparing a plurality of workpieces for concurrent cutting using a stone cutting machine; the stone cutting machine having a plurality of stone cutting elements and being configured to concurrently create a plurality of stone cuts; the method comprising the steps of:

providing a plurality of workpieces, each of the plurality of workpieces comprising (i) a stone slab having two parallel faces and one or more edges, (ii) a substrate bonded to a first face of the stone slab, and (iii) a substrate bonded to a second face of the stone slab, each workpiece having a top surface when positioned in a horizontal orientation; and positioning the plurality of workpieces as a stack of workpieces to position each of the workpieces with one edge of each stone slab in relative alignment with one of the stone cutting elements, wherein the positioning step comprises:

(a) establishing one or more reference sites on a rack, the rack configured to accept a plurality of workpieces in a horizontal orientation and to present the stack of workpieces in a vertical orientation for cutting;

(b) placing a first workpiece on the rack in a horizontal orientation;

(c) measuring the top surface of the first workpiece relative to the one or more reference sites;

(d) calculating a first shim level;

(e) arranging a first set of shims on top of the top surface of the first workpiece, the first set of shims arranged according to the first shim level; and (f) placing a second workpiece on the rack in a horizontal orientation, the second workpiece placed on top of the first set of shims.

9. The method of claim 8 further comprising the initial steps of:

measuring the top surface of the rack relative to at least one reference site;

calculating a preliminary shim level; and arranging a preliminary set of shims on top of the top surface of the rack, the preliminary set of shims arranged according to the preliminary shim level.

10. A method of preparing a plurality of workpieces for concurrent cutting using a stone cutting machine; the stone cutting machine having a plurality of stone cutting elements and being configured to concurrently create a plurality of stone cuts; the method comprising the steps of:

providing a plurality of workpieces, each of the plurality of workpieces comprising (i) a stone slab having two parallel faces and one or more edges, (ii) a substrate bonded to a first face of the stone slab, and (iii) a substrate bonded to a second face of the stone slab, each workpiece having a top surface when positioned in a horizontal orientation; and positioning the plurality of workpieces as a stack of workpieces to position each of the workpieces with one edge of each stone slab in relative alignment with one of the stone cutting elements, wherein the positioning step comprises:

(a) placing a first workpiece on a rack in a horizontal orientation, the rack configured to accept a plurality of workpieces in a horizontal orientation;

(b) measuring the top surface of the first workpiece to determine (i) the flatness of the top surface, and (ii) an angle that a first plane, substantially through the top surface, makes with a horizontal plane;

(c) measuring the thickness of a second workpiece;

(d) calculating a first shim level, the first shim level being a calculation including (i) the flatness of the top surface of the first workpiece, (ii) the angle that the first plane makes with the horizontal plane, (iii) the position of at least one of the plurality of stone cutting elements, and (iv) the thickness of the second workpiece;

(e) arranging a first set of shims on top of the top surface of the first workpiece, the first set of shims arranged according to the first shim level; and (f) placing the second workpiece on the rack in a horizontal orientation, the second workpiece placed on top of the first set of shims.

11. A method of preparing a plurality of workpieces for concurrent cutting using a stone cutting machine; the stone cutting machine having a plurality of stone cutting elements and being configured to concurrently create a plurality of stone cuts; the method comprising the steps of:

providing a plurality of workpieces, each of the plurality of workpieces comprising (i) a stone slab having two parallel faces and one or more edges, (ii) a substrate bonded to a first face of the stone slab, and (iii) a substrate bonded to a second face of the stone slab, each workpiece having a top surface when positioned in a horizontal orientation; and positioning the plurality of workpieces as a stack of workpieces to position each of the workpieces with one edge of each stone slab in relative alignment with one of the stone cutting elements, wherein the positioning step comprises:

(a) placing a first workpiece on a rack in a horizontal orientation, the rack configured to accept a plurality of workpieces in a horizontal orientation and to present the stack of workpieces in a vertical orientation for cutting;

(b) determining the position of the stone slab relative to a reference site using a measuring device;

(c) calculating a first shim level;

(d) arranging a first set of shims on top of the top surface of the first workpiece, the first set of shims arranged according to the first shim level; and (e) placing a second workpiece on the rack in a horizontal orientation, the second workpiece placed on top of the first set of shims.

12. The method of claim 1, wherein the substrate bonded to the first face of the stone slab is a honeycomb substrate, and the substrate bonded to the second face of the stone slab is a honeycomb substrate.

13. A method for preparing a plurality of workpieces for concurrent cutting, comprising the steps of:

(a) providing a stone cutting machine that is configured to make vertical cuts; the stone cutting machine having a plurality of stone cutting elements and being configured to concurrently create a plurality of stone cuts;

(b) providing a rack configured to accept a plurality of workpieces in a horizontal orientation and to present the plurality of workpieces in a vertical orientation for cutting;

(c) providing a plurality of workpieces for cutting, each of the plurality of workpieces comprising (i) a stone slab having two parallel faces and one or more edges, (ii) a substrate bonded to a first face of the stone slab, and (iii) a substrate bonded to a second face of the stone slab, each workpiece having a top surface when positioned in a horizontal orientation;

(d) establishing one or more reference sites on the rack;

(e) placing a first workpiece on the rack in a horizontal orientation;

(f) measuring the top surface of the first workpiece relative to the one or more reference sites;

(g) calculating a first shim level, the first shim level being a calculation including (i) the measurement of the top surface of the first workpiece and (ii) the position of at least one of the plurality of stone cutting elements;

(h) arranging a first set of shims on top of the top surface of the first workpiece, the first set of shims arranged according to the first shim level; and (i) placing a second workpiece on the rack in a horizontal orientation, the second workpiece placed on top of the first set of shims.

14. The method of claim 13, wherein step (f) further comprises using a measurement device.

15. A method for preparing a plurality of workpieces for concurrent cutting, comprising the steps of:

(a) providing a stone cutting machine having a plurality of stone cutting elements that is configured to concurrently create a plurality of stone cuts;

(b) providing a rack configured to accept a plurality of workpieces in a horizontal orientation and to present the plurality of workpieces in a vertical orientation for cutting;

(c) providing a plurality of workpieces for cutting, each of the plurality of workpieces comprising (i) a stone slab having two parallel faces and one or more edges, (ii) a substrate bonded to a first face of the stone slab, and (iii) a substrate bonded to a second face of the stone slab each workpiece having a top surface when positioned in a horizontal orientation;

(d) establishing one or more reference sites on the rack; and (e) sequentially (i) measuring the top surface of each workpiece relative to the one or more reference sites after horizontal placement in position on the rack, (ii) calculating a shim level for the workpiece, and (iii) arranging a set of shims on the top surface of the workpiece (at one or more shim sites) according to the shim level for the workpiece.

16. The method of claim 15, further comprising the steps of:

(f) securing the stack of workpieces in a fixed position on the rack;

(g) rotating the rack, with the workpieces, to a vertical orientation;

(h) placing the rack in the cutting machine with each stone slab in relative alignment with one cutting element; and (i) cutting each slab to create two stone laminate panels.

17. The method of claim 15, further comprising the initial steps of:

measuring the top surface of the rack relative to at least one reference site;

calculating a preliminary shim level; and arranging a preliminary set of shims on top of the top surface of the rack, the preliminary set of shims arranged according to the preliminary shim level.

18. The method of claim 15 wherein measuring the top surface of each workpiece comprises determining the position of a center of the edge of the stone slab of each workpiece.

* * * * *